United States Patent [19]

Rosberg et al.

[11] Patent Number: 4,546,888

[45] Date of Patent: Oct. 15, 1985

[54] JEWELRY CHAIN HOLDER AND METHOD OF FORMING SAME

[76] Inventors: Carl H. Rosberg; Hazel N. Rosberg, both of 111 Airport Rd., Hyannis, Mass. 02601

[21] Appl. No.: 568,699

[22] Filed: Jan. 6, 1984

[51] Int. Cl.[4] ..... A47F 5/08

[52] U.S. Cl. ..... 211/87; D6/323; 72/379

[58] Field of Search ..... 211/87, 61, 66, 70.7, 211/88, 13; D6/553, 323, 571; 411/461–472; 72/379; 59/80, 82, 91

[56] References Cited

U.S. PATENT DOCUMENTS

| | | | |
|---|---|---|---|
| D. 33,702 | 12/1900 | Steppe | D6/553 |
| D. 33,849 | 1/1901 | Meyer | 211/13 X |
| 177,113 | 5/1876 | Fracker | 211/87 |
| D. 236,567 | 9/1975 | Ballin | D6/323 |
| D. 268,890 | 5/1983 | Morin | D6/553 X |
| D. 271,545 | 11/1983 | Licari | D6/323 |
| 272,685 | 2/1883 | Hart | 411/466 X |
| 1,048,776 | 12/1912 | Williams | 72/379 |
| 1,795,038 | 3/1931 | Prestinari | 59/80 |
| 2,066,825 | 1/1937 | Cohen | 211/13 |
| 2,492,393 | 12/1949 | Muray | 59/80 |
| 2,895,369 | 7/1959 | Andersen | 411/466 |
| 3,967,524 | 7/1976 | Snow | 411/461 |
| 4,094,415 | 6/1978 | Larson | 211/87 X |
| 4,264,013 | 4/1981 | Vollmer | 211/13 |
| 4,326,761 | 4/1982 | Schwartz | 211/13 X |
| 4,390,099 | 6/1983 | Trautlein | 211/13 X |

*Primary Examiner*—Ramon S. Britts
*Assistant Examiner*—Sarah A. Lechok
*Attorney, Agent, or Firm*—Hamilton, Brooks, Smith & Reynolds

[57] ABSTRACT

A holder body designed for attachment to a vertical wall surface includes an elongated sheet material such as sheet metal, plastic or the like formed along upper and lower edges of the holder with spaced apart hook portions extending horizontally outwardly and substantially at right angles to intermediate portions of the holder body. The hook portions are further characterized by V-shaped indentations or creases and outer extremities of the hooks are bent upwardly to constitute retaining tips for loosely receiving a plurality of jewelry chains in suspended, separated relationship. Forming dies are employed in a series of separated steps to produce the construction described from a unitary blank member.

2 Claims, 20 Drawing Figures

Fig. 9A
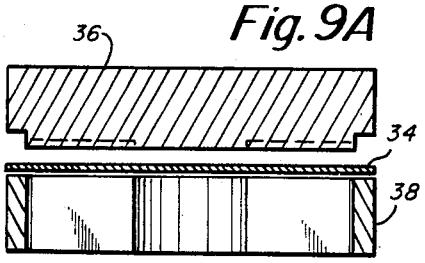
Fig. 9B
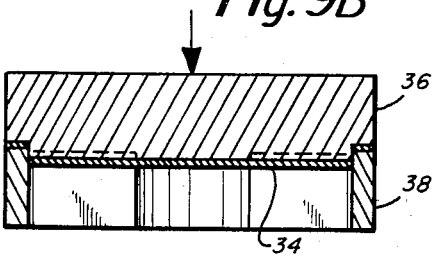
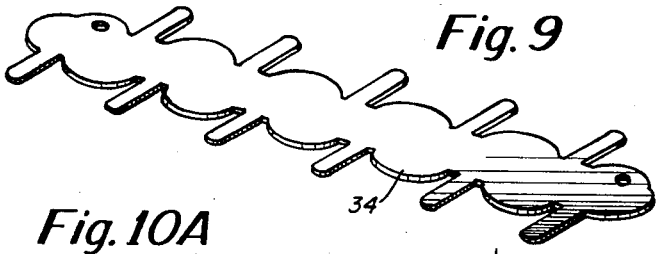
Fig. 9
Fig. 10A
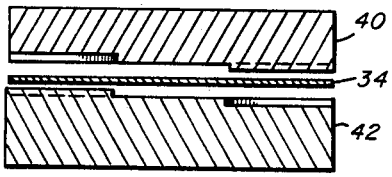
Fig. 10B
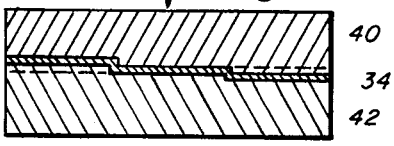
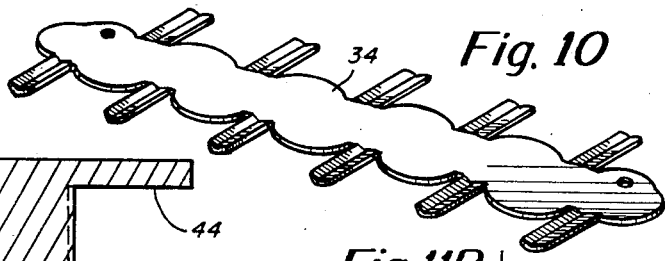
Fig. 10
Fig. 11A
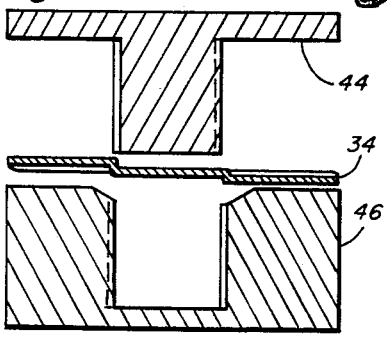
Fig. 11B
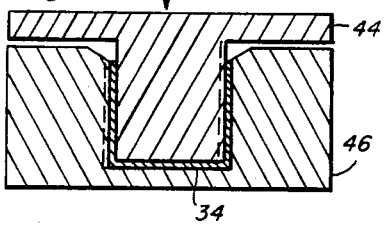
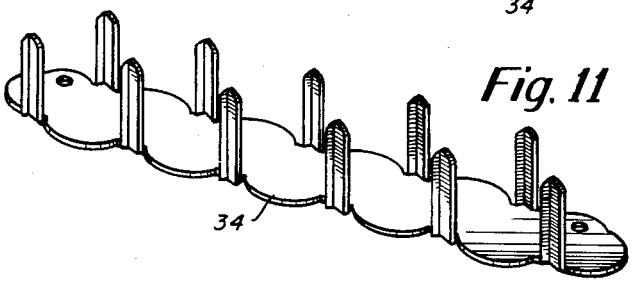
Fig. 11

JEWELRY CHAIN HOLDER AND METHOD OF FORMING SAME

BACKGROUND OF THE INVENTION

It is well known in the art to provide wall racks of various designs for use in supporting necklaces and other forms of jewelry as well as wearing apparel such as neck ties, scarves and the like.

Various forms of such wall racks are disclosed for example in design patents as follows:

| | | |
|---|---|---|
| 52,485 | 168,850 | 236,567 |
| 59,456 | 168,927 | 243,055 |
| 96,745 | 174,257 | 247,761 |
| 121,045 | 197,014 | 249,751 |
| 127,295 | 213,115 | 257,807 |
| 135,750 | 216,708 | 259,311 |
| 136,900 | 221,236 | 259,314 |
| 168,529 | 232,676 | |

All of these designs are concerned with ornamental design or appearance rather than utility and it is understood in using these conventional jewelry racks difficulty may be experienced due to chain portions becoming tangled with one another and troublesome knotting may occur.

In the invention device an arrangement of parts is provided by which jewelry chains may be vertically suspended in suitably separated relationship so that knotting may be avoided.

SUMMARY OF THE INVENTION

This invention relates to an improved jewelry chain holder and to a method of forming the holder to provide a unique retaining hook arrangement. It is a chief object of the invention to provide an improved jewelry chain holder. Another object is to construct a jewelry chain holder from a unitary blank or sheet of material.

A further object of the invention is to devise in combination a holding body and right angularly disposed portions arranged in staggered relationship at both upper and lower edges of the holding body.

Still another object is to devise a unique method of forming a jewelry chain holder and to provide spaced apart portions which are reinforced by means of creases or indentations.

BRIEF DESCRIPTION OF THE DRAWINGS

FIG. 9 illustrates a formed body produced by a first step in the invention method of making a jewelery chain holder.

FIG. 9A illustrates die means located above and below a blank sheet of material.

FIG. 9B illustrates the dies in a closed position to provide the structure of FIG. 9.

FIG. 10 is a perspective view illustrating a further step in the forming of the holder body.

FIG. 10A illustrates die means for carrying out a second step in the invention method to provide creases or indentations in the hook means.

FIG. 10B shows the die members in a closed position.

FIG. 11 is a perspective view illustrating the hooks turned out substantially at right angles.

FIG. 11A illustrates die means for further forming the blank.

FIG. 11B shows the die means of FIG. 11A in a closed position.

DETAILED DESCRIPTION OF THE INVENTION

Figure 1:
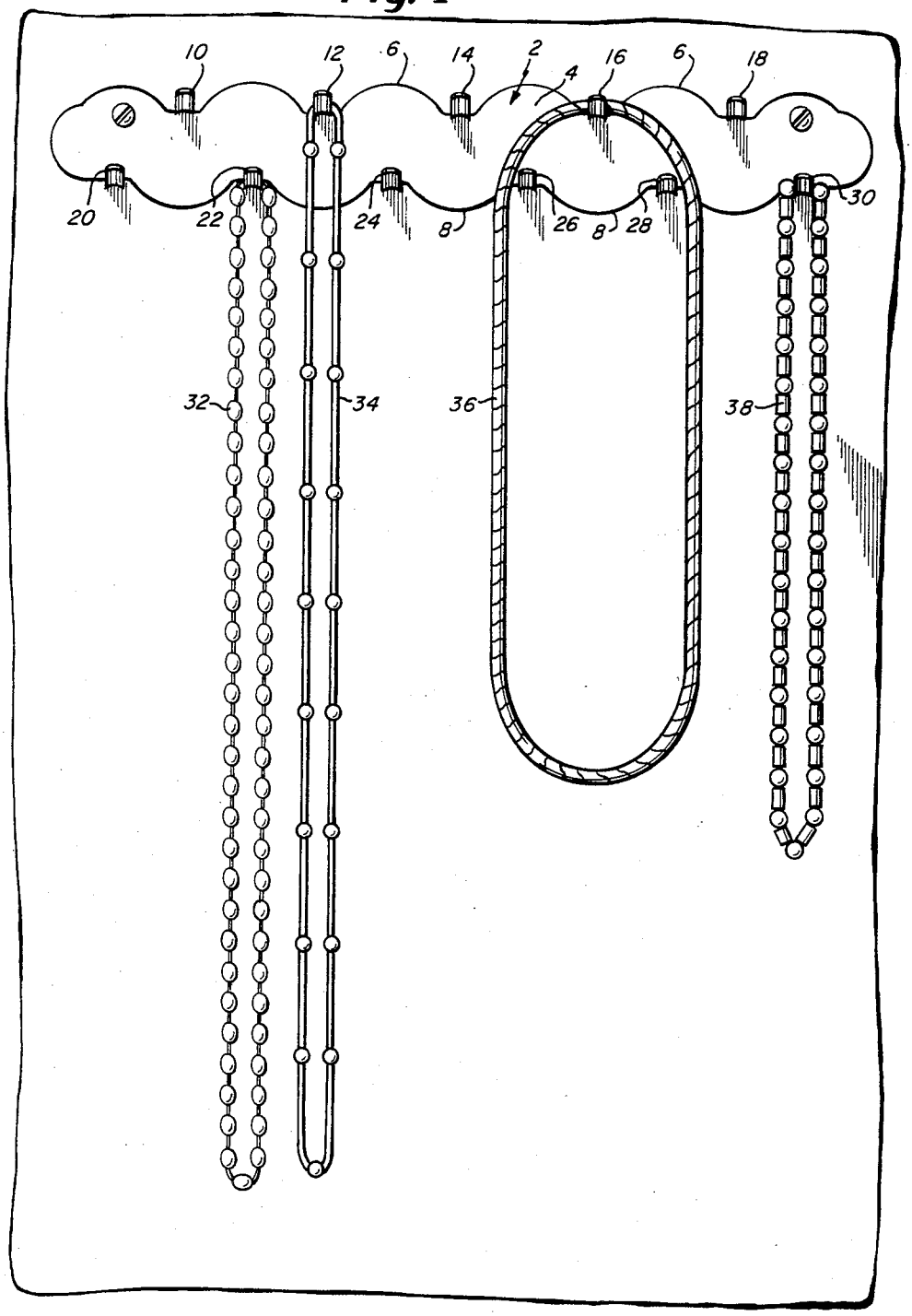
FIG. 1 is an elevational view showing the jewelry chain holder of the invention mounted against a wall surface and illustrating a plurality of jewelry chains suspended therefrom.
Figure 3:
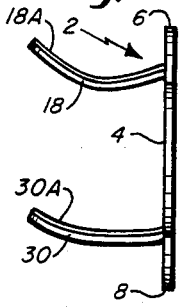
FIG. 3 is an end elevational view of the holder body.

Referring in more detail to the structure shown in the Figures, arrow 2 generally denotes an elongated, relatively thin sheet material which may consist of sheet metal, plastic or other desirable substance. The elongated body includes a body portion 4 having upper and lower scalloped edges 6 and 8, as shown in FIG. 2, and having means such as mounting holes 2A for supporting the body on a support surface.

Arranged in uniformly spaced relation between the upper scalloped portions 6 are hooks as 10, 12, 14, 16 and 18 which are formed integrally with the body portion 2 and which extend angularly outwardly therefrom. Each of the hooks are formed with indentations or creases 10A, 12A, 14A, 16A and 18A.

Figure 2:
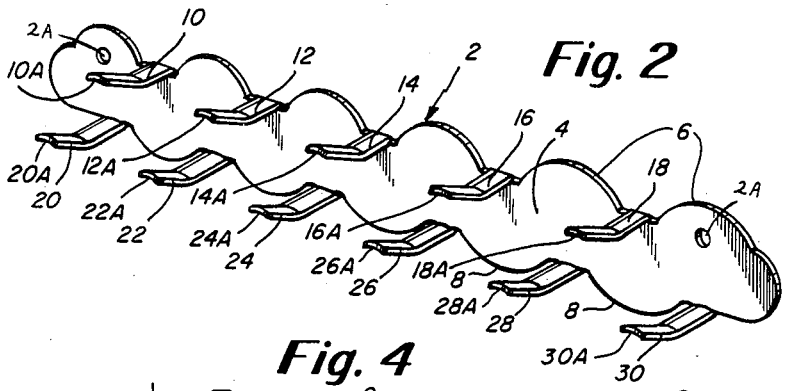
FIG. 2 is a perspective view illustrating the jewelry chain holder removed from the wall surface.
Figure 4:
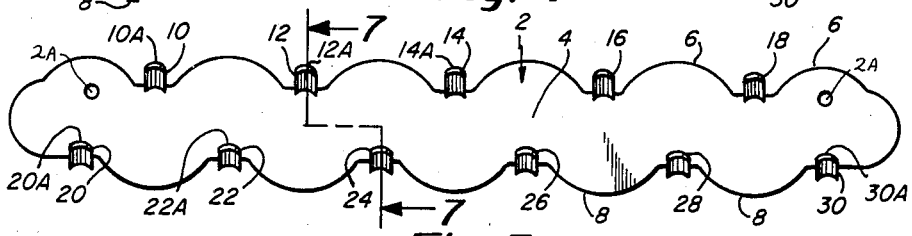
FIG. 4 is an elevational view further showing the staggered arrangement of the hooks occurring in uniformly spaced apart relationship.
Figure 5:
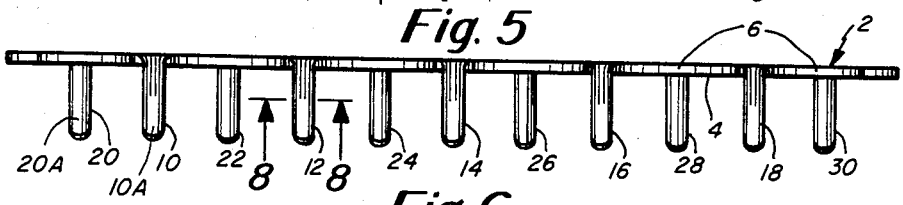
FIG. 5 is a plan view of the invention.
Figure 6:
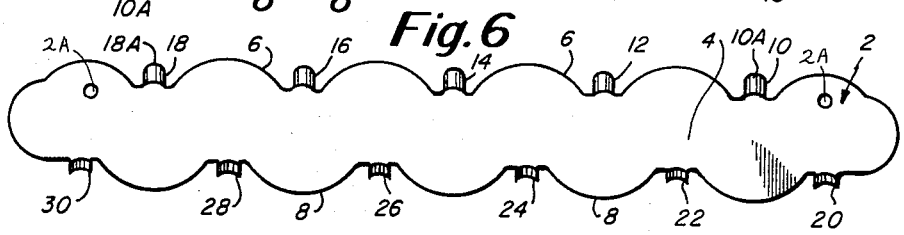
FIG. 6 is another elevational view of the holder body.
Figure 7:
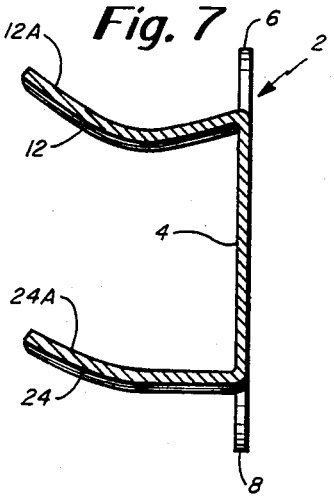
FIG. 7 is a cross-sectional view taken on the line 7—7 of FIG. 4.
Figure 8:
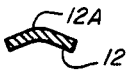
FIG. 8 is a cross-section taken on the line 8—8 of FIG. 5.

Similarly, hook elements 20, 22, 24, 26, 28 and 30 extend angularly outwardly, being formed integrally with the elongated body portions at points between the lower scalloped edge 8, as shown in FIG. 2. These hook elements at the lower scalloped edge 8 are also formed with indentations or creases 20A, 22A, 24A, 26A, 28A and 30A.

It is pointed out that outer tips of the hook elements of FIG. 2 are bent upwardly and the indentations or creases are arranged to provide for rounded bearing surfaces over which the jewelry chain may readily slide when placed thereon.

In FIG. 1 a plurality of chains as 32, 34, 36, 38 are shown suspended over the bearing surfaces of the hook elements and it will be observed that with the staggered arrangement of the scalloped parts and intervening hook elements all of the jewelry chains are firmly maintained in uniformly spaced apart relation to resist tangling or knotting and each chain is free to slide over the bearing surfaces, thus preventing any accidental tangling.

As one suitable method of forming the holder construction above-disclosed there may be employed the steps illustrated in FIGS. 9A, 9B, 10A, 10B, 11A, 11B, 12A and 12B. As shown in FIG. 9A a blank 34 is supported between an upper die 36 and a lower die 38 and in FIG. 9B the dies are closed and there is produced the formed part shown in FIG. 9.

Figure 12A:
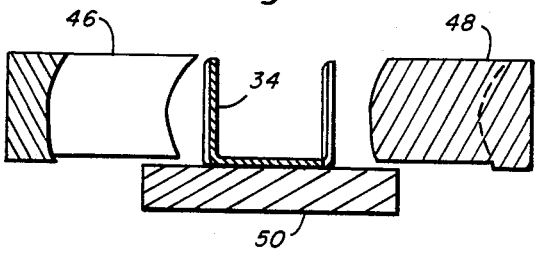
FIG. 12A and FIG. 12B illustrate die means for producing the structure of FIG. 12.
Figure 12B:
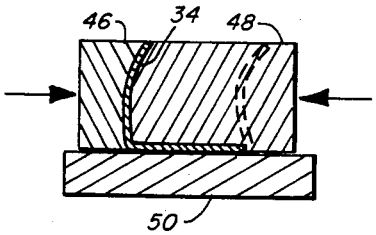
Figure 12:
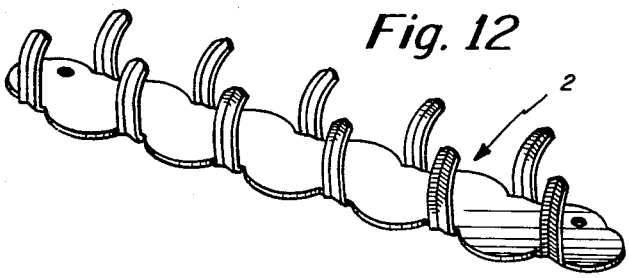
FIG. 12 is a perspective view showing the finally formed holder with ends of hooks turned upwardly.

This formed part of FIG. 9 is then placed between forming dies as 38, 40 and 42 and when the dies are closed, as illustrated in FIG. 10B, there is produced the structure of FIG. 10. A further forming step is accomplished by dies 44 and 46 and when these dies are closed they form the structure shown in FIG. 11. A final forming step is achieved by dies 48 and 50 and when these dies are moved together the finally formed product if FIG. 12 is produced.

We claim:

1. A jewelry chain holder comprising:

a. an elongate body of sheet material, the body having an upper edge and a lower edge and having means for attaching the body to a support surface; and b. a plurality of hooks integral with the body and projecting outwardly from the body and formed from the same single sheet of material as the elongate body, the hooks being uniformly spaced in an upper row along the upper edge and a lower row along the lower edge of the body, the hooks of the lower row being in vertically intermediate positions with relation to the hooks of the upper row, the hooks being reinforced lengthwise with creases, the creases formed to provide rounded, upper bearing surfaces of the hooks, and each of the hooks having upwardly curved outer extremities.

2. A method of constructing a jewelry chain holder, comprising the steps of:

a. placing a sheet material between upper and lower cutting die members;

b. closing the cutting die members to cut the sheet material into a flat, unitary, elongate body having a plurality of hook portions extending outwardly from an upper edge and a lower edge of the elongate body;

c. placing the elongate body between first upper and lower forming dies to shape the hook portions with creases, the hook portions on the upper edge of the elongate body being formed to protrude from one face of the elongate body and the hook portions on the lower edges of the elongate body being formed to protrude from the other face of the elongate body;

d. engaging the elongate body between second forming dies to bend the hook portions outwardly at substantially right angles to the body; and e. subjecting the hook portions to third forming dies to provide the hooks with upwardly curved extremities.

* * * * *